United States Patent [19]

Movshovich et al.

[11] 4,068,459

[45] Jan. 17, 1978

[54] METHOD OF TWIST-PLYING A FIBROUS PRODUCT

[76] Inventors: Pavel Mikhailovich Movshovich, Pechatnikov pereulok, 3, kv. 8; Gennady Konstantinovich Maximov, Kaspiiskaya ulitsa, 20, korpus 3, kv. 137, both of Moscow; Viktor Pavlovich Khavkin, ulitsa Vatutina, 11, kv. 4, Moskovskaya oblast, Khimki; Lev Nikolaevich Ivanov, Kotelnicheskaya naberezhnaya, 25/8, kv. 74, Moscow; Natalya Borisovna Babushkina, Chasovaya ulitsa, 5b, kv. 15, Moscow; Vladimir Konstantinovich Afanasiev, Galyanovsky proezd, 4a, kv. 219, Moscow; Tamara Nikolaevna Kudryavtseva, Davydkovskaya ulitsa, 6, kv. 5, Moscow; Sergei Vladimirovich Nezelenov, Kineshemskoe shosse, 8a, kv. 6, Kostroma, all of U.S.S.R.

[21] Appl. No.: 699,935

[22] Filed: June 25, 1976

[30] Foreign Application Priority Data

July 22, 1975 U.S.S.R. ..... 2158695

[51] Int. Cl.[2] ..... D02G 3/26; D01H 7/90

[52] U.S. Cl. ..... 57/156; 57/34 AT

[58] Field of Search ..... 57/34 AT, 156, 157 F

[56] References Cited

U.S. PATENT DOCUMENTS

| | | | |
|---|---|---|---|
| 3,306,023 | 2/1967 | Henshaw et al. | 57/34 AT |
| 3,468,120 | 9/1969 | Hildebrand | 57/34 AT |
| 3,537,251 | 11/1970 | Kimura et al. | 57/34 AT X |
| 3,717,988 | 2/1973 | Walls | 57/34 AT |

*Primary Examiner*—Richard C. Queisser
*Assistant Examiner*—Charles Gorenstein
*Attorney, Agent, or Firm*—Steinberg & Blake

[57] ABSTRACT

The present invention relates to methods of twist-plying a fibrous product. In accordance with the proposed method, applied to each of two fibrous ribbons is a pulsating torque created by a vortex of air of an invariable direction. Apart from the pulsating torque, each fibrous ribbon is constantly subjected to an additional torque of the opposite direction. The amount of the additional torque is less than that of the pulsating torque and is equal to 0.1 - 0.8 of its amount. As a result, each of the fibrous ribbons acquires a sign-variable twist. The fibrous ribbons are thereafter joined together and, while untwisting on each other, they become interlaced, thereby forming the finished product. This makes it possible to enhance the quality of the product, to reduce the end breakage thereof, and to improve both the stability and reliability of the process.

10 Claims, 4 Drawing Figures

METHOD OF TWIST-PLYING A FIBROUS PRODUCT

The present invention relates to spinning processes and, more particularly, it relates to methods of twist-plying a fibrous product (yarn, roving).

In accordance with a known method, applied alternately to each of two or more continuously fed fibrous ribbons is a pulsating torque.

The direction of the torque acting upon one fibrous ribbon is opposite to the direction of the torque applied to the adjacent fibrous ribbon, whereby each of the fibrous ribbons is caused to acquire a sign-variable twist. The fibrous ribbons are thereafter joined together and, while untwisting on each other, they become interlaced, thereby forming a finished product to be wound onto a bobbin.

In the course of spinning of the product by the above method during each half-cycle the joined fibrous ribbons are alternately in a free state. Since this state occurs when the feeding speed of the fibrous ribbons exceeds the speed of winding of the finished product, this condition being necessary for accomplishing the twisting process, the free fibrous ribbon not subjected to the torque gets loose and forms lapups.

Besides, during each half-cycle the point of joining of the fibrous ribbons shifts towards the fibrous ribbon acted upon by the torque because the other fibrous ribbon is in a free condition, and vice versa.

The floating of the point of joining of the fibrous ribbons renders the linear density of the product irregular due to a false drafting imposed on the untwisted fibrous ribbon when the latter interlaces the twisted fibrous ribbon which raises the breakage rate, increases the length of portions with the "zero" twist and the lengthwise asymmetry thereof due to variations in the relationship of the lengths of the twisting zones (from the nipping point of the fibrous ribbon to the point of application of the torque and from the point of application of the torque to the point of joining of the fibrous ribbons) and, in the final analysis, impairs the quality of the product.

There is also known another method of twist-plying a fibrous product.

In accordance with this method, each of two or more fibrous ribbons is simultaneously subjected to pulsating torques of the same direction created by vortices of air, as a result of which each fibrous ribbon acquires the sign-variable twist. Thereafter, the fibrous ribbons are joined together and, while partially untwisting relative to one another, they become interlaced, thereby forming a finished product.

In this method during every other half-cycle both fibrous ribbons are simultaneously in a free state which causes the point of joining of the fibrous ribbons to float noticeably and, as a consequence, the relationship of the lengths of the twisting zones to change, thereby increasing both the irregularity of the linear density and the length of the portions with the "zero" twist as well as the lengthwise assymetry thereof, with inferior quality of the product being the result.

Besides, the fibrous ribbons, while being in a free condition, may lap around the delivery rolls and ends down may occur.

The pulsating torques applied simultaneously to the joined fibrous ribbons cause irregular twisting of the product by half-cycles because the absence of the torque during one half-cycle leads to lessening of the twist in the fibrous ribbons due to the arrival of the untwisted material in the twisting zone, which results in the twist varying from one half-cycle to another.

The object of the present invention is to obviate the above disadvantages.

The principal object of the present invention is to provide a method of twist-plying a fibrous product which will eliminate conditions for loosening of the fibrous ribbon not subjected to twisting, thereby making it possible to fix the position of the point of joining of the fibrous ribbons and, consequently, to cut down the breakage rate and to enhance the quality of the product.

This and other objects are attained by that in a method of twist-plying a fibrous product, there is applied to each of two or more continuously fed fibrous ribbons a pulsating torque created by a vortex of air of an invariable direction. Thus each of the fibrous ribbons is caused to acquire a sign-variable twist. The fibrous ribbons are joined together and, while untwisting on each other, they become interlaced, thereby forming a finished product which is then wound on a bobbin. In accordance with the present invention, apart from the pulsating torque, each fibrous ribbon is constantly subjected to an additional torque of the opposite direction, the amount of which torque is less than that of the pulsating torque.

Preferably, the amount of the additional torque should be 0.1 – 0.8 of that of the pulsating torque.

The application of the additional torque helps to fix the position of the fibrous ribbon at the moment when no pulsating torque is applied to the same fibrous ribbon because at that very moment the fibrous ribbon is acted upon by the additional torque.

Moreover, the direction of the additional torque applied to the fibrous ribbon with no pulsating torque applied thereto coincides with the direction of the pulsating torque acting upon the adjacent fibrous ribbon, as a result of which the joined fibrous ribbons are subjected to torques of the same direction. Thus floating of the point of joining is precluded and false drafting as well as the asymmetry of the portions with the "zero" twist are eliminated, whereas the length of the latter is increased with the relationship of the twisting zones maintained invariable.

Taken together, these factors reduce the breakages of the product, make the process more stable and reliable, and enhance the quality of the product.

It can be seen that the herein disclosed method ensures improvement of quality of the product, reduction of breakage rate, and adds to stability and reliability of the process.

Given below is a detailed description of the present invention with reference to the accompanying drawings, wherein.

Figure 1:
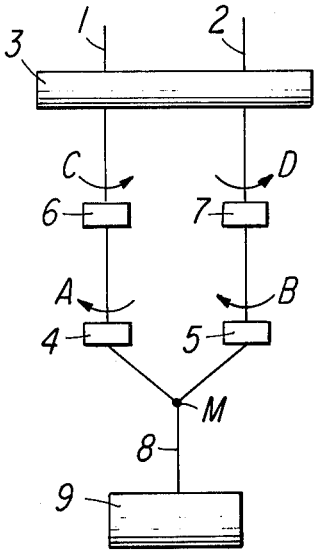
FIG. 1 shows schematically an embodiment of the invention.

Referring now to the drawings, the method of twist-plying a fibrous product is realized as follows.

Applied to each fibrous ribbon, for instance, 1 and 2 (FIG. 1) continuously fed from drafting rolls 3 is a pulsating torque created by vortices of air of an invariable direction, respectively, in a chamber 4 for the fibrous ribbon 1 and in a chamber 5 for the fibrous ribbon 2. Consequently, each fibrous ribbon acquires a sign-variable twist. In accordance with the invention, each of the fibrous ribbons 1 and 2 apart from the pulsating torque applied thereto in the chambers 4 and 5 is constantly subjected to an additional torque set up by a vortex of air in a chamber 6 for the fibrous ribbon 1 and in a chamber 7 for the fibrous ribbon 2. These additional torques are constant or variable in value, but are opposite in direction to the pulsating torque.

The amount of the additional torque acting upon each fibrous ribbon is less than that of the pulsating torque and constitutes 0.1 – 0.8 of the latter.

Subsequently, the fibrous ribbons 1 and 2 are joined together at a point M and while untwisting on each other, they become interlaced, thereby forming a finished product 8 which is wound onto a bobbin 9.

The disclosed method has two embodiments.

Figure 2:
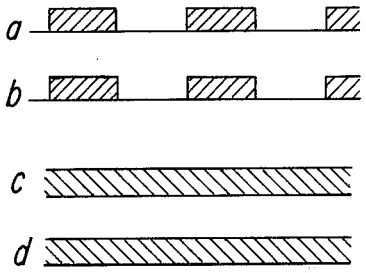
FIG. 2 shows diagrams of torques according to the embodiment shown in FIG. 1.

In accordance with one embodiment (FIG. 1), two fibrous ribbons 1 and 2 are simultaneously subjected to pulsating torques of the same direction shown in FIG. 1 by arrows A and B and in FIG. 2 by diagrams *a* and *b*. At the same time, the fibrous ribbons 1 and 2 are constantly acted upon by additional torques whose direction is shown in FIG. 1 by arrows C and D and in FIG. 2 by diagrams *c* and *d*, respectively. The direction of the additional torques is opposite to that of the pulsating torques.

As a result, each of the fibrous ribbons, with no pulsating torque applied, is subjected to the action of an additional torque which contributes to stabilization of the position of the free fibrous ribbon and the point of joining of the fibrous ribbons and, hence, to stabilization of the relationship of the lengths of the twisting zones, whereby the quality of the product is enhanced, the stability and reliability of the process are increased, and the end breakages reduced.

Figure 3:
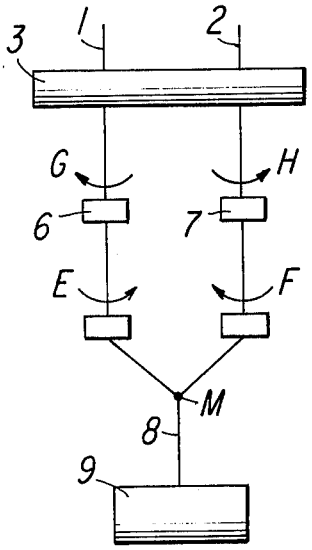
FIG. 3 shows schematically another embodiment of the invention.
Figure 4:
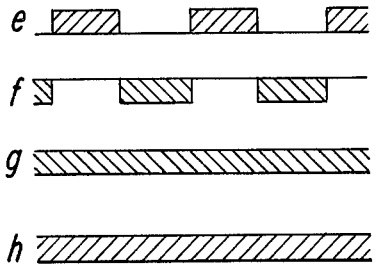
FIG. 4 shows diagramsof torques according to the method shown in FIG. 3.

In accordance with the embodiment of the invention (FIG. 3), alternately applied to each of continuously fed fibrous ribbons 1 and 2 is a pulsating torque created by a vortex of air of an invariable direction, the direction of the pulsating torque applied to the fibrous ribbon 1 (shown in FIG. 3 by arrow E and in FIG. 4 by diagram *e*) being opposite to that of the pulsating torque acting upon the fibrous ribbon 2 (shown in FIG. 3 by arrow F and in FIG. 4 by diagram *f*). At the same time, the fibrous ribbons are constantly subjected to the action of additional torques, the direction thereof for each fibrous ribbon being opposite to that of the pulsating torques (shown in FIG. 3 by arrows G and H and in FIG. 4 by diagrams *g* and *h*). Thus, the direction of the additional torque acting upon the fibrous ribbon 1 coincides with the direction of the pulsating torque applied to the fibrous ribbon 2, and, the direction of the additional torque acting upon the fibrous ribbon 2 coincides with the direction of the pulsating torque applied to the fibrous ribbon 1 as is shown in FIG. 4.

As a result, when no pulsating torque is applied to one of the fibrous ribbons, the latter is subjected to the action of the additional torque having a direction which coincides with that of the pulsating torque applied at that moment to the adjacent fibrous ribbon, which means that during each half-cycle the joined fibrous ribbons are acted upon by torques of the same direction, which precludes floating of the point M of joining of the fibrous ribbons.

Due to the fixed position of the point of joining of the fibrous ribbons, the relationship of the lengths of the twisting zones is maintained constant, false drafting is eliminated as is the asymmetry of the portion with "zero" twist, whereas the length of the latter is increased.

What is claimed is:

1. A method of twist-plying a fibrous product, comprising the steps of continuously feeding at least two fibrous ribbons; applying to each continuously fed fibrous ribbon a pulsating torque of an invariable direction, created by a vortex of air; simultaneously with said pulsating torque subjecting each fibrous ribbon constantly to an additional torque the direction of which is opposite to that of the pulsating torque and the amount of which is less than that of the pulsating torque, whereby each fibrous ribbon is caused to acquire a sign-variable twist; and then joining said fibrous ribbons together so that, while untwisting on each other, they are caused to interlace, thereby forming a finished product; and then winding the finished product onto a bobbin.

2. A method as claimed in claim 1, wherein the amount of the additional torque constitutes 0.1 – 0.8 of that of the pulsating torque.

3. A method as claimed in claim 1, wherein said additional torque is constant in value.

4. A method as claimed in claim 1, wherein said additional torque is variable in value.

5. A method as claimed in claim 1, wherein said pulsating torque is simultaneously applied to both said ribbons.

6. A method as claimed in claim 5, wherein the pulsating torque applied to one fibrous ribbon has the same direction as the pulsating torque applied to the other fibrous ribbon.

7. A method as claimed in claim 1, wherein the pulsating torque is alternately applied to said fibrous ribbons.

8. A method as claimed in claim 7, wherein the pulsating torque applied to one fibrous ribbon has a direction opposite to the direction of the pulsating torque applied to the other fibrous ribbon.

9. A method as claimed in claim 1, wherein the pulsating torques respectively applied to said fibrous ribbons respectively have the same direction.

10. A method as claimed in claim 1, wherein the pulsating torques respectively applied to said fibrous ribbons respectively have opposite directions.

* * * * *